United States Patent [19]

Becker et al.

[11] Patent Number: 4,636,461

[45] Date of Patent: Jan. 13, 1987

[54] PHOTOGRAPHIC RECORDING MATERIAL

[75] Inventors: Manfred Becker; Reinhart Matejec, both of Leverkusen; Lothar Endres, Bergisch Gladbach, all of Fed. Rep. of Germany

[73] Assignee: Agfa Gevaert Aktiengesellschaft, Leverkusen, Fed. Rep. of Germany

[21] Appl. No.: 696,901

[22] Filed: Jan. 31, 1985

[30] Foreign Application Priority Data

Feb. 11, 1984 [DE] Fed. Rep. of Germany ..... 3404854

[51] Int. Cl.[4] ..... G03C 1/34; G03C 1/02

[52] U.S. Cl. ..... 430/567; 430/569; 430/544

[58] Field of Search ..... 430/567, 569

[56] References Cited

U.S. PATENT DOCUMENTS 4,045,228 8/1977 Vanassche et al. ..... 430/567

4,504,570 3/1985 Evans et al. ..... 430/567

4,507,386 3/1985 Matsuzaka et al. ..... 430/569

FOREIGN PATENT DOCUMENTS 1027146 4/1966 United Kingdom .

OTHER PUBLICATIONS

Radcliffe, "The Effects of Crystal Size, Iodide Content and Iodide Distribution on the Covering Power and Rate of Development at $D_{MAX}$ of Sensitized, Cubic Monosize Emulsions in ID2 and ID11 Developers," Journal of Photo. Science, vol. 24, 1976, pp. 198–202.

*Primary Examiner*—Richard L. Schilling

*Attorney, Agent, or Firm*—Connolly and Hutz

[57] ABSTRACT

Photographic recording materials containing a silver halide emulsion in which the grains have zones of differing iodide content provide improved sensitometric results.

7 Claims, No Drawings

PHOTOGRAPHIC RECORDING MATERIAL

This invention relates to a photographic recording material containing at least one silver halide emulsion layer with grains having a layered grain structure.

Silver halide crystals having a layered grain structure comprising an outer shell and at least one internal zone are known. GB-PS No. 1,027,146, for example, describes crystals having a core of silver bromide covered by a zone of silver iodobromide which in turn is covered by a shell of silver bromide. Silver halide emulsions in which the silver halide grains have a core of silver iodide covered by a shell of some other silver halide are disclosed in DE-OS No. 3,205,896 and GB-A No. 2,095,853. Silver halide grains having an internal zone relatively rich in iodides covered by an outer zone having a relatively low iodide content have also been disclosed in European Patent No. 0 006 543 and in Canadian Patent No. 1,155,325. According to Example 4 of the European Patent, a silver chlorobromide emulsion is partially converted by iodide. A fine grained silver bromide emulsion is added to the resulting emulsion in the presence of silver halide solvents. This may be carried out on the assumption that the silver halide grains of the fine grained silver bromide emulsion are precipitated on the converted silver halides. It is also known from European Patent No. 0 006 543 that the emulsions described therein show a pronounced reaction to the presence of DIR compounds in the process of photographic development.

It is known that the sensitometric properties of a recording material may be controlled by compounds which release diffusible substances in the course of development to inhibit development of the silver halide. Such compounds include the DIR couplers disclosed in GB No. 953,454, which carry in the coupling position a substituent which is split off in the coupling reaction to release a diffusible compound which inhibits the development of silver halide. DIR couplers may be used to improve the colour graininess and control the interimage effect.

Similar effects may also be produced with compounds which do not produce a permanent dye, as may be seen for U.S. Pat. No. 3,632,345 and DE-OS No. 2,359,295. In the description which follows, compounds which react with colour developer oxidation products to release diffusible, organic substances inhibiting the development of silver halide will be regarded as DIR compounds.

DIR compounds have also been described in U.S. Pat. No. 3,227,554, DE-OS No. 2,853,362, U.S. Pat. No. 4,315,040 and European Patent Application No. 70183. It is known that DIR compounds may be used to improve the colour quality by interimage effects and the image sharpness by edge effects: see e.g. C. R. Barr, J. R. Thirtle and P. W. Vittum, Phot. Sci. Engn., 13 (1969) 74.

Other DIR compounds known to improve the interimage effects and sharpness by edge effects react to colour development by first splitting off intermediate compounds which do not inhibit development, but these intermediate compounds are subsequently decomposed in a secondary reaction to release development inhibitors, see e.g. U.S. Pat. No. 4,248,962 and GB Patent No. 2,072,363.

Yet other known DIR compounds react to colour development by splitting off inhibitors which are inactivated after some time by a secondary reaction in the colour developer, thereby preventing the accumulation of inhibitors in the developer bath.

Apart from the nature of the DIR compounds, the intensity of interimage and edge effects also depends upon the silver haide emulsion. It is known that, in colour negative materials, coarse grained emulsions produce both effects more strongly than fine grained emulsions.

It was an object of the present invention to provide photographic recording materials containing improved emulsions. It was a particular object to provide emulsions which would enable a high edge effect to be obtained in recording materials in the presence of DIR compounds.

A photographic recording material comprising at least one iodide-containing silver halide emulsion comprising substantially silver halide grains with zones of differing halide compositions has been found. These grains are characterised in that:

(a) from the surface of the grain to the centre they have at least three successive zones of differing halide compositions and the local iodide content assumes a maximum in at least one position which is neither on the surface nor at the centre;

(b) the difference between the iodide content in the zone with the highest iodide content and the iodide content in the zone with the lowest iodide content situated further away from the centre of the grain is at least 6 mol-%, preferably at least 8 mol-%, more preferably at least 9 mol-%;

(c) the proportion of zones (in mol-% silver halide) in which the iodide content assumes a maximum is from 10 to 60%, preferably from 15 to 50%, more preferably from 20 to 40%; and (d) at least 50%, preferably at least 70%, of the silver halide crystals are cubes or tetradecahedrons or transitional forms between cubes and tetradecahedrons.

Rounded crystal edges and corners may occur in the case of the transitional forms.

All the zones of the crystals may also contain chloride in addition to bromide and iodide. Preferably at least one zone in which the iodide content does not assume a maximum contains chloride and the chloride content within such zones is preferably at least 1.5 mol-%, more preferably at least 30 mol-%. A zone in which the iodide content assumes a maximum is one in which the iodide content is higher than that in the two immediately adjacent zones.

The boundaries between the zones of differing compositions may be sharp or blurred. In the case of a blurred boundary, the boundary between adjacent zones is defined in that the iodide content at the boundary is equal to the mean value of the iodide contents of the homogeneous regions of the adjacent zones.

The following Table 1 gives a schematic representation of suitable grain structures without limiting the present invention to these types of grain. The zones are given in their order from the grain surface to the centre (core).

TABLE 1

| Zone | Arrangement of zones: Composition | Proportion of the zone in the grain (mol %) |
|---|---|---|
| 1 | Ag(Br, I), below 2% $I^-$ | 15 |
| 2 | Ag(Cl, Br), above 30% $Cl^-$ | 15 |
| 3 | Ag(Br, I), above 12% $I^-$ | 40 |
| 4 | AgBr (core) | 30 |
| 1 | AgBr | 25 |
| 2 | Ag(Br, I), above 7% $I^-$ | 60 |
| 3 | AgBr (core) | 15 |
| 1 | Ag(Br, I) below 4% $I^-$ | 20 |
| 2 | Ag(Br, I), above 12% $I^-$ | 50 |
| 3 | AgBr | 10 |
| 4 | Ag(Cl, Br), above 30% $Cl^-$ | 10 |
| 5 | $AgCl_{0.13}Br_{0.87}$ (core) | 10 |
| 1 | AgBr | 30 |
| 2 | Ag(Br, I), above 18% $I^-$ | 18 |
| 3 | AgBr | 8 |
| 4 | $AgCl_{0.5}Br_{0.5}$ | 10 |
| 5 | AgBr | 8 |
| 6 | Ag(Br, I), above 18% $I^-$ | 18 |
| 7 | AgBr (core) | 8 |

The silver halide grains to be used according to the present invention may be prepared by various techniques (e.g. single inflow, double inflow, constant or accelerated inflow of substance, Ostwald ripening). Photographically active compounds, such as compounds of copper, thallium, lead, bismuth, cadmium, ruthenium, rhodium, palladium, osmium, iridium, platinum, gold, sulphur, selenium or tellurium, may be present during precipitation. The silver halide emulsions according to the the present invention may be precipitated in a monodisperse or polydisperse form. They may be mixed with each other or with other emulsions.

Monodisperse emulsions having a composition such that 70% of spheres having the same volume as the emulsion grains have diameters ranging from 0.8 to 1.3 times the most frequent sphere diameter are particularly preferred.

The emulsions to be used according to the present invention may be chemically sensitized by known methods, e.g. by means of active gelatine or compounds of sulphur, selenium, tellurium, gold, palladium, platinum or iridium, and the pAg values may vary from 5 to 10, the pH values from 5 to 8 and the temperatures from 30° to 90°C. Compounds which may be added during chemical sensitization include thiocyanate derivatives, thioethers and heterocyclic nitrogen compounds, such as imidazoles, azaindenes, azapyridazines and azapyrimidines. In place of or in addition to such treatment, the emulsions according to the present invention may be subjected to sensitization by reduction, e.g. by hydrogen, by a low pAg value (e.g. below 5) and/or high pH (e.g. above 8), and by reducing agents, such as tin(II) chloride, thiourea dioxide and aminoboranes. The nuclei on the surface may also be converted into so-called "troglodyte nuclei" (subsurface nuclei) according to DE-OS No. 2,306,447 and U.S. Pat. No. 3,966,476.

Other methods have been described in Research Disclosure No. 17643 of December 1978, Section III, published by Industrial Opportunities Ltd., Homewell Havant, Hampshire, PO9 1 EF, Great Britian.

The emulsions may also be optically sensitized in known manner, e.g. by means of the conventional polymethine dyes, such as neutrocyanines, basic or acid carbocyanines, rhodacyanines, hemicyanines, styryl dyes, oxonols and the like. Sensitizers of this type have been described by F. M. Hamer in "The Cyanine Dyes and related Compounds", (1964). Particular reference may also be made to Ullmanns Encylopädie der technischem Chemie, 4th Edition, Volume 18, pages 431 et seq and to the above Research Disclosure No. 17643, Section IV. The spectral sensitization may be carried out at any stage in the preparation of the emulsion, i.e. during or after precipitation of the silver halide and before, during or after chemical sensitization.

The conventional anti-fogging agents and stabilizers may also be used.

Particularly suitable stabilizers are the azaindenes, particularly the tetra- or penta-azaindenes, especially those substituted with hydroxyl or amino groups. Compounds of this type have been described, for example in the Article by Birr, Z.Wiss.Phot. 47, 1952, pages 2–58. Other suitable stabilizers and anti-fogging agents are mentioned in the above Research Disclosure No. 17643, Section IV.

The recording material preferably contains DIR compounds. These may be present in a silver halide emulsion layer or in a layer associated therewith.

The inhibiting substances released from the DIR compounds are preferably mercapto compounds e.g. 1-phenyl-5-mercaptotetrazole. The inhibiting substance may be released directly by the reaction of the DIR compound with the developer oxidation product, but they may in some cases be released only after they have split off from a retarding group.

Suitable DIR compounds have been disclosed, for example, in DE-OS No. 2,707,489 and correspond to the following general formula:

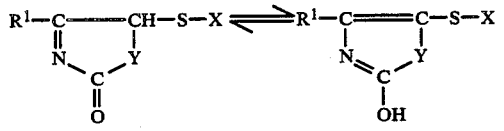

wherein $R^1$ represents an optionally substituted hydrocarbyl group,

Y represents —S— or —$NR^2$ wherein $R^2$ represents hydrogen, a substituted or unsubstituted hydrocarbyl group, a heterocyclic group attached through a ring carbon atom or an electron attracting substituent; and X represents an aliphatic group, an aromatic group or in particular a heterocyclic group which, when split off with the sulphur atom of the thioether bridge, forms a diffusible mercapto compound inhibiting the development of the silver halide.

By "hydrocarbyl group" is meant an aliphatic or aromatic hydrocarbon group, e.g. a substituted or unsubstituted alkyl or aryl group.

Examples of aliphatic hydrocarbon groups represented by $R^1$ and $R^2$ include alkyl groups having from 1 to 18 carbon atoms which may be straight-chained, branched or cyclic and may be substituted alkoxy, aroxy, aryl, halogen, carboxyl or sulphor groups, e.g. methyl, isopropyl, t-butyl, dodecyl, heptadecyl, benzyl, phenylethyl, carboxy t-butyl or methoxypropyl.

The particular compounds of the thiazole and imidazole series listed under 1 to 30 in DE-OS No. 2,707,489 and U.S. Pat. No. 4,183,752 are particularly suitable.

Particularly suitable DIR compounds have also been disclosed in DE-OS No. 2,853,362 and U.S. Pat. Nos. 3,227,554 and 4,315,070. Particularly preferred DIR compounds of this type are illustrated in Table 2 below:

TABLE 2

| No. | Compound |
|---|---|
| 1 | 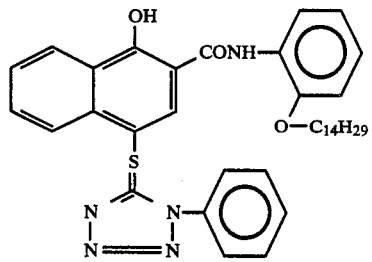 |
| 2 | 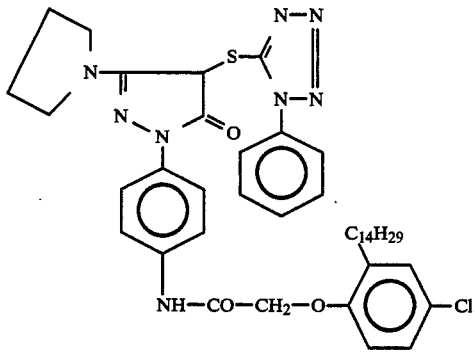 |
| 3 | 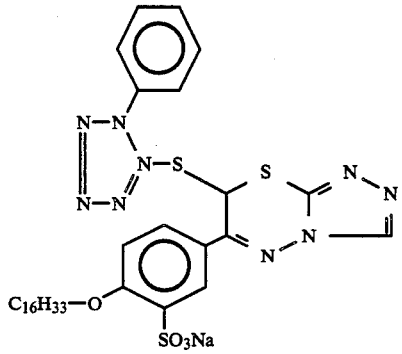 |
| 4 | 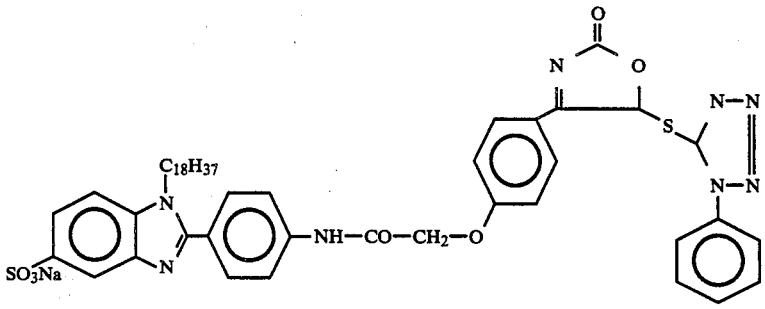 |

TABLE 2-continued

| No. | Compound |
|---|---|
| 5 | 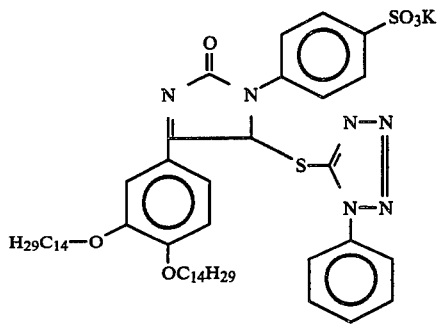 |
| 6 | 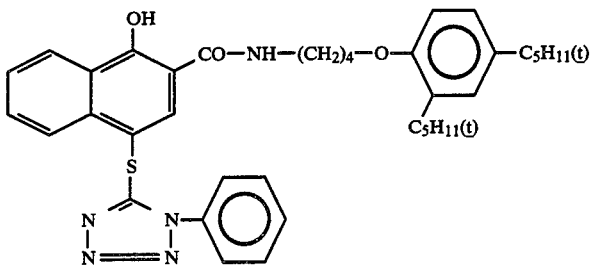 |
| 7 | 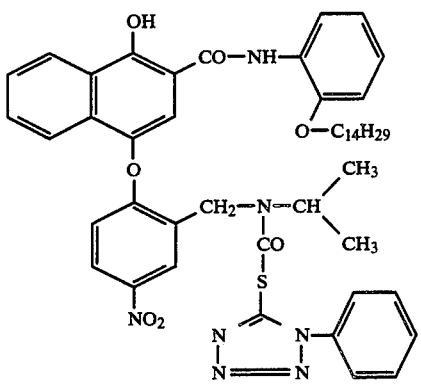 |
| 8 | 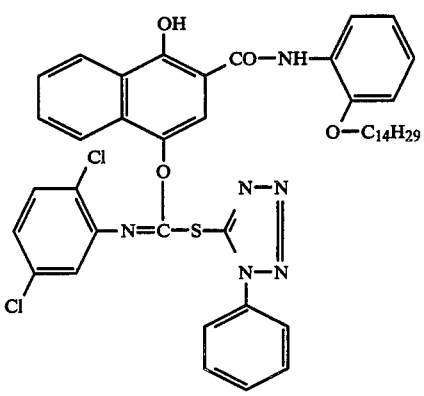 |

A remarkable increase of the edge effect can be observed if the silver halide emulsion associated with the DIR compound contains stabilizers, sensitizers or other compounds which can be adsorbed on the surface of the silver halide grains. Preferred are S-containing heterocyclic compounds containing a N-atom as ring member.

The recording material according to the present invention is preferably a colour photographic material. In a preferred embodiment, the colour image is produced by means of colour couplers. These colour couplers may be arranged to diffuse into the recording material only at the stage of development.

In a preferred embodiment, however, the photographic material itself contains the conventional colour couplers which are capable of reacting with the oxidation product of developers, generally p-phenylene diamine, to form dyes.

Thus, the red-sensitive layer may, for example, contain a non-diffusible colour coupler to produce the cyan partial colour image, generally a coupler of the phenol or α-napthol series. The green-sensitive layer may, for example, contain at least one non-diffusible colour coupler to produce the magenta partial colour image, usually a colour coupler of the 5-pyrazolone series. The blue-sensitive layer may, for example, contain a non-diffusible colour coupler to produce the yellow partial colour image, generally a colour coupler having an open-chained ketomethylene group. The colour couplers may be, for example, 6-, 4- or 2-equivalent couplers, including so-called "white couplers" which do not produce a dye in the reaction with colour developer oxidation products. Suitable couplers have been disclosed, for example, in the publication "Farbkuppler" by W. Pelz in "Mitteilungen aus den Forschungslaboratorien der Agfa, Leverkusen/München", Volume III, page 111 (1961), K. Venkataraman in "The Chemistry of Synthetic Dyes", Vol. 4, 341 to 387, Academic Press (1971) and T. H. James, "The Theory of the Photographic Process", 4th Edition, pages 353–362, as well as Research Disclosure No. 17643 of December 1978, Section VII.

The colour couplers and DIR compounds may be incorporated in the materials according to the present invention by conventional methods. If the compounds are soluble in water or alkalies, they may be added in the form of aqueous solutions, optionally with the addition of water-miscible organic solvents, such as ethanol, acetone or dimethylformamide. If the colour couplers or DIR compounds are insoluble in water or alkalies, they may, as is known, be incorporated in the recording materials in the form of dispersions. For example, a solution of these compounds in a low boiling organic solvent may be mixed directly with the silver halide emulsion or it may first be mixed with an aqueous gelatine solution and, after removal of the organic solvent, the resulting dispersion of the compound may be mixed with the silver halide emulsion. So-called "oil-formers" may be used in addition; these are generally relatively high boiling organic compounds in which the colour couplers and DIR compounds which are to be dispersed become enclosed in the form of oily droplets. See, in this connection, for example U.S. Pat. Nos. 2,322,027; 2,533,514; 3,689,271; 3,764,336 and 3,756,897.

The recording materials according to the present invention preferably contain at least one silver halide emulsion unit for recording blue, green and red light.

The red-sensitive silver halide emulsion layer unit is generally arranged nearer to the layer support than the green-sensitive silver halide emulsion unit, which in turn is arranged nearer to the support than the blue-sensitive unit. In a preferred embodiment, at least one of the units for the recording of green, red and blue light consist of at least two partial layers.

Partial layers differing in spectral sensitivity may also be combined according to their speed.

The conventional layer supports may be used for the materials according to the present invention, e.g. supports of cellulose esters, such as cellulose acetate, or of polyesters. Paper supports are also suitable, optionally coated, e.g. with polyolefins, in particular polyethylene or polypropylene; see, for example, the above-mentioned Research Disclosure No. 17643, Section XVII.

The conventinal hydrophilic film-forming agents may be used as protective colloids or binders for the layers of the recording material, e.g. proteins, in particular gelatine, alginic acid or derivatives thereof, such as esters, amides or salts, cellulose derivatives, such as carboxymethyl cellulose or cellulose sulphates, starches or derivatives thereof or hydrophilic synthetic binders, such as polyvinyl alcohol, partially saponified polyvinyl acetate, polyvinyl pyrrolidone, and others. The hydrophilic binders of the layers may also be mixed with other synthetic binders in the form of solutions or dispersions, such as homo- or co-polymers of acrylic or methacrylic acid or derivatives thereof, such as esters, amides or nitriles, or vinyl polymers, such as vinyl esters or vinyl ethers; see also the binders mentioned in the above Research Disclosure 17643 in Section IX.

The layers of the photographic material may be hardened in the conventional manner, for example, by means of epoxide hardeners or heterocyclic ethylene imine or acryoyl hardeners. The layers may also be hardened by the process according to German Offenlegungsschrift No. 2,218,009 to obtain colour photographic materials suitable for high temperature processing. The photographic layers or colour photographic multilayered materials may also be hardened using hardeners of the diazine, triazine or 1,2-dihydroquinoline series or with vinyl sulphone hardeners. Other suitable hardeners have been disclosed in German Offenlegungsschrift Nos. 2,439,551; 2,225,230 and 2,317,672 and in the above Research Disclosure 17643, Section XI.

The photographic materials according to the present invention may also contain other substances, in particular plasticizers, wetting agents, screening dyes, light scattering agents, light reflecting agents, lubricants, antistatic agents, matting agents, etc.; see Research Disclosure 17643 and "Product Licensing Index" of December 1971, pages 107–110.

Suitable colour developer substances for the material according to the present invention include in particular those of the p-phenylene diamine series, e.g. 4-amino-N,N-diethylaniline hydrochloride, 4-amino-3-methyl-N-ethyl-N-β-(methane-sulphonamido-ethylaniline sulphate hydrate, 4-amino-3-methyl-N-ethyl-N-β-hydroxyethylaniline sulphate; 4-amino-N-ethyl-N-(2-methoxyethyl)-m-toluidine-di-p-toluene sulphonic acid and N-ethyl-N-β-hydroxyethyl-p-phenylene diamine. Other suitable colour developers have been described, for example, in J. Amer. Chem. Soc. 73, 3100 (1951) and in G. Haist, Modern Photographic Processing, 1979, John Wiley and Sons, New York, pages 545 et seq.

After colour development, the material is bleached and fixed in the conventional manner. Bleaching and fixing may be carried out separately or together. The conventional compounds may be used as bleaching agents, e.g. $Fe^{3+}$ salts and $Fe^{3+}$ complex salts, such as ferricyanides, dichromates, water-soluble cobalt complexes, etc. Iron-III complexes of aminopolycarboxylic acids are particularly preferred, e.g. ethylene diaminotetracetic acid, nitrilotriacetic acid, iminodiacetic acid, N-hydroxyethyl-ethylene diaminotriacetic acid, alkyliminodicarboxylic acids and corresponding phosphonic acids. Persulphates are also suitable bleaching agents.

EXAMPLES OF EMULSIONS

Emulsion A (Comparison Emulsion)

A silver chloroiodobromide emulsion containing 5 mol-% chloride, 92 mol-% bromide and 3 mol-% iodide was prepared by the method disclosed in EP No. 0 006 543. If each crystal is assumed to be a sphere having the same volume as the crystal, the most frequently occurring sphere diameter was 0.23 μm, 90% of the sphere diameters were greater than 0.17 μm and 90% of the diameters were less than 0.45 μm.

The crystals obtained had a plate-shaped to isometric habit and some of the boundary surfaces were octahedral surfaces, others were curved.

Emulsion B (Homodisperse Comparison Emulsion)

A silver iodobromide emulsion containing 99.1 mol-% bromide and 0.9 mol-% iodide was prepared by the double inflow process.

2000 ml of a 0.5 molar $AgNO_3$ solution and 2000 ml of a 0.5 molar KBr solution were introduced by the double inflow process, each at a rate of 200 ml/min, into 7 liters of an aqueous solution containing 230 g of gelatine, 0.8 g of potassium bromide and 61.5 g of 1-methylimidazole at 63° C. and pH 6.35 with stirring. The pAg was then adjsuted to 7.2 and 3000 ml of a 2 molar $AgNO_3$ solution and the quantity of a 2 molar $KBr_{0.985}I_{0.015}$ solution required to keep the pAg constant were introduced by the double inflow process.

Finally, 1500 ml of a 2 molar $AgNO_3$ solution and the quantity of a 2 molar KBr solution required to keep the pAg constant were added by the double inflow process. The emulsion was then flocculated, washed, redispersed with a solution of 365 g of gelatine in 2700 ml of water and adjusted to pH 5.6 and pAg 9.0. The silver halide crystals were cubical with a length of edge of 0.5 μm.

The emulsion was chemically ripened at 56° C., using 18 μmol of $Na_2S_2O_3.5H_2O$/mol of Ag, 5.8 μmol of $HAuCl_4$/mol of Ag and 340 μmol of KSCN/mol of Ag, and then spectrally sensitized with 400 μmol/mol of Ag of a sensitizer for the red spectral region.

The emulsion was thus built up of three zones (Table 3) in which the difference in iodide content did not reach 6%:

TABLE 3

| Emulsion | Zone | Composition | Mol percent |
|---|---|---|---|
| B | 1 | AgBr | 30 |
| (Compar- | 2 | $AgBr_{0.985}I_{0.015}$ | 60 |
| ison) | 3 | AgBr | 10 |

Emulsion C (Present Invention)

A silver iodobromide emulsion built up of three zones and containing 95.05 mol-% of bromide and 4.95 mol-% of iodide was prepared by the double inflow process.

2000 ml of a 0.5 molar $AgNO_3$ solution and 2000 ml of a 0.5 molar KBr solution were added to 7 liters of an aqueous solution containing 230 g of gelatine, 0.8 g of potassium bromide and 61.5 g of 1-methylimidazole by the double inflow process at pH 6.35 and 63° C. with stirring. 3000 ml of a 2 molar $AgNO_3$ solution and the quantity of a 2 molar $KBr_{0.92}I_{0.08}$ solution required to keep the pAg constant were then added by the double inflow process at pAG 8.0, the rate of inflow of the $KBr_{0.92}I_{0.08}$ solution being adjusted to maintain the pAg constant at 8.0.

A further 1500 ml of 2 molar $AgNO_3$ solution and the quantity of 2 molar $KBr_{0.995}I_{0.005}$ solution required to keep the pAg constant were then added at the same pAg by the double inflow process. The emulsion was then flocculated, washed, redispersed with a solution of 365 g of gelatine in 2700 ml of water and adjusted to pH 5.6 and pAg 9.0. The silver halide crystals were cubical with a length of edge of 0.5 μm.

The emulsion was chemically ripened at 56° C., using 32 μmol of $Na_2S_2O_3.5H_2O$/mol of Ag, 10.2 μmol of $HAuCl_4$/mol of Ag and 610 μmol of KSCN/mol of Ag, and then spectrally sensitized with 400 μmol/mol of Ag of the sensitizing dye used in Example B.

The emulsion was thus built up of three zones (Table 4), zone 2 having an iodide content which exceeded that of the adjacent zone by more than 6%.

TABLE 4

| Emulsion | Zone | Composition | Mol percent |
|---|---|---|---|
| C | 1 | $AgBr_{0.995}I_{0.005}$ | 30 |
| (Present | 2 | $AgBr_{0.92}I_{0.08}$ | 60 |
| invention) | 3 | AgBr | 10 |

Emulsion D (Present Invention)

A silver chloroiodobromide emulsion built up of four zones was prepared by a method analogous to that used for emulsions B and C. This emulsion contained 2.0 mol-% of chloride, 90.6 mol-% of bromide and 7.33 mol-% of iodide and had the sequence of zones shown in Table 5.

TABLE 5

| Emulsion | Zone | Composition | Mol percent |
|---|---|---|---|
| D | 1 | $AgBr_{0.995}I_{0.005}$ | 26 |
| (Present | 2 | $AgCl_{0.5}Br_{0.5}$ | 4 |
| Invention) | 3 | $AgBr_{0.8}I_{0.2}$ | 36 |
| | 4 | AgBr | 34 |

The cubical silver halide crystals had a length of edge of 0.5 μm and were chemically ripened for 3 hours at 56° C. with 24 μmol of $Na_2S_2O_3.5H_2O$/mol of Ag, 7.3 μmol of $HAuCl_4$/mol of Ag and 435 μmol of KSCN/mol of Ag and then spectrally sensitized with 400 μmol/mol of Ag of the sensitizing dye indicated in Example B.

Emulsion E (Present Invention)

A silver chloroiodobromide emulsion prepared analogously to emulsions B, C and D and containing 2.0 mol-% of chloride, 90.25 mol-% of bromide and 7.75 mol-% of iodide and built up of seven zones as shown in Table 6 was chemically ripened and spectrally sensitized in the same manner as Emulsion D.

TABLE 6

| Emulsion | Zone | Composition | Mol percent |
|---|---|---|---|
| E | 1 | $AgBr_{0.995}I_{0.005}$ | 30 |
| (Present | 2 | $AgBr_{0.8}I_{0.2}$ | 18 |
| Invention) | 3 | AgBr | 9 |
| | 4 | $AgCl_{0.5}Br_{0.5}$ | 4 |
| | 5 | AgBr | 9 |
| | 6 | $AgBr_{0.8}I_{0.2}$ | 20 |
| | 7 | AgBr | 10 |

All the emulsions were chemically ripened in such a manner as to produce optimum photographic sensitivity in each case.

Emulsion F (Present Invention)

A solution of 1000 g of $AgNO_3$ in 6.6 l of water and a solution of 531 g of ammonium bromide and 5 g of potassium iodide in 10 l of water were added by double inflow to a solution of 97 g of ammonium bromide and 300 g of gelatine in 11.5 l of water at 65° C. in the course of 6 minutes with vigorous mixing. A proportion of the grain obtained at this stage was then converted by the addition of a solution of 120 g of potassium iodide in 10 i of water at the rate of 0.3 l/min. This conversion transformed the previously homogeneous grain into a grain consisting of an inner zone having a low iodide content, an outer zone having a high iodide content and a transitional region (zone boundary not sharp). The iodide content of the outer zone is determined mainly by the mixing gap. After 20 minutes, the emulsion obtained is flocculated, washed and redispersed in 6 l of water.

To this emulsion, containing a total of 12.5 mol-% AgI and having an average grain diameter of 0.16μ, is added that quantity of a very fine grained Ag(Br,Cl,I) emulsion (average grain diameter 0.1μ) containing 0.4 mol-% AgI and 2 mol-% AgCl and having a gelatine concentration of 27 g/kg which contains a quantity of silver corresponding to 500 g of $AgNO_3$. The resulting emulsion mixture is subjected to Ostwald ripening at 65° C., pH 7.0 and pAg 7.8 in the presence of 75 g of imidazole. After the emulsion has been flocculated and washed and the flocculate has been dispersed in 4.4 kg of a gelatine solution having a gelatine concentration of 3.7%, by weight, gold-sulphur ripening is carried out with the quantities of ripening agents resulting in optimum sensitivity with low fog. The average grain diameter of the emulsion obtained is approximately 0.5μ. Spectral sensitization was carried out using 400 μmol per mol of Ag of the sensitizer indicated in Example B Emulsion G (Present Invention)

The emulsion was prepared as described in Example F, except that the composition of the halide mixture in one solution of the double inflow was changed to 477 g of ammonium bromide and 97 g of potassium iodide. The potassium iodide solution added after the double inflow contained 28 g of potassium iodide.

The emulsion obtained after Ostwald ripening had an average grain diameter of about 0.5μ. Spectral sensitization was carried out as for Emulsion F.

LAYER ARRANGEMENTS

Example 1 (Cyan single layers)

0.5 kg portions of the above-mentioned emulsions A to E containing, per kg, the quantity of silver halide equivalent to 200 g of $AgNO_3$ and 70 g of gelatine were each stabilized with 50 ml of a 1% aqueous solution of 4-hydroxy-6-methyl-1,3,3a-7-tetraazaindene and mixed with a colour coupler emulsion consisting of 25 g of the colour coupler corresponding to the following formula:

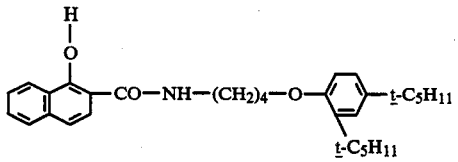

25 g of tricresyl phosphate and 25 g of gelatine.

To one set of these casting solutions was added in each case 0.75 g of DIR compound 1, while to a second set was added 1.0 g of DIR compound 1.

The DIR compound was emulsified with tricresyl phosphate and gelatine in proportions, by weight, of 1:1.

The casting solutions obtained were cast on layer supports (silver application: 3.0 g per $m^2$) and hardened.

The amount of "edge effect" (to prevent light scattering) was determined by exposure to X-rays as described by T. H. James, The Theory of the Photographic Process, 4th Edition, Macmillan Publ. Co. Inc. New York/-London (1977) pages 609–614: Both a macrofield and a strip 30 μm in width were exposed on the samples, using the same X-ray dose for each. The samples were then processed by the colour negative process described in "The British Journal of Photography", 1947, pages 597 and 598. The density difference between the strip (microdensity) and the macrofield (macrodensity) found on these samples at that X-ray dose at which macrodensity = 1.0 serves in Table 7 below as a measure of the magnitude of the edge effect.

TABLE 7

| | Edge effect at macro colour density = 1.0 | |
|---|---|---|
| Emulsion | 0.75 g of DIR compound per 100 g of $AgNO_3$ | 1.0 g of DIR compound per 100 g of $AgNO_3$ |
| A | 0.27 | 0.25 |
| B | 0.24 | 0.38 |
| C | 0.40 | 0.54 |
| D | 0.48 | 0.60 |
| E | 0.66 | 0.84 |

Example 2 (Multiple Layered Material)

The four layer combinations 2A, 2B, 2F and 2G described below were prepared, using the two Comparison emulsions A and B and the two emulsions according to the present invention F and G. These four layer combinations differ from each other only in the emulsions used in the low sensitivity cyan layer (third layer) and in the low sensitivity magenta layer (6th layer). The quantities given are based in each case on 1 $m^2$. The quantities of silver halide applied are given in terms of the corresponding quantities of $AgNO_3$.

All the silver halide emulsions of this material were stabilized with 0.5 g of 4-hydroxy-6-methyl-1,3,3a,7-tetraazaindene per 100 g of $AgNO_3$.

To prepare these four layer combinations, the following layers were applied in the sequence given (quantities per $m^2$) to a transparent layer support of cellulose triacetate:

1st Layer: (Antihalation layer):

Black colloidal silver sol containing 1.5 g of gelatine and 0.33 g of Ag.

2nd Layer: (intermediate layer)

0.6 g of gelatine.

3rd layer: (low sensitivity, red-sensitized layer)

The four variations of layer combinations 2A, 2B, 2F and 2G contained, in this 3rd layer, emulsion A, B, F or G, respectively, in each case in an amount of 3.8 g of $AgNO_3$ sensitized to the red spectral region, and this 3rd layer also contained 2.5 g of gelatine, 0.9 g of cyan coupler corresponding to the following formula:

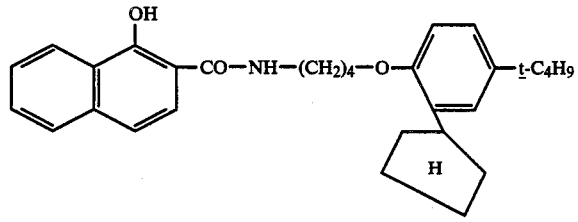

and 0.1 g of a conventional masking coupler.

In addition, this layer contained 75 mg of DIR compound 7.

4th Layer: (highly sensitive, red-sensitized layer)

Red-sensitized silver iodobromide emulsion (6.5 mol-% iodide, average grain diameter 0.8 μm) containing 3.9 g of $AgNO_3$, 2.0 g of gelatine and 0.2 g of the cyan coupler contained in the 3rd layer.

5th Layer: (intermediate layer):

0.7 g of gelatine and 0.2 g of diisooctylhydroquinone.

6th Layer: (low sensitivity, green-sensitized layer)

In this 6th layer, the four variations of layer combinations, 2A, 2B, 2F and 2G contained emulsion A, B, F or G, respectively, in each case in an amount of 2.5 g of $AgNO_3$, but sensitized to the green region of the spectrum.

This 6th layer in addition contained 2.4 g of gelatine, 0.6 g of magenta coupler corresponding to the following formula:

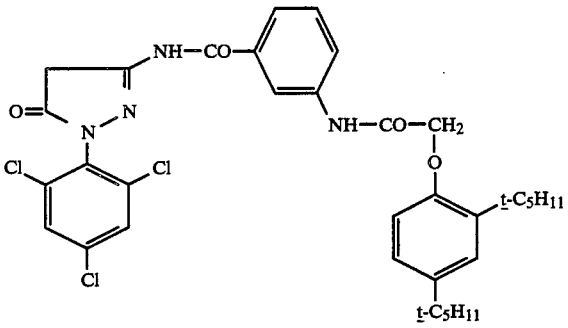

75 mg of a conventional masking coupler and 30 mg of DIR compound 2.

7th Layer: (highly sensitive, green-sensitized layer)

Green-sensitized silver iodobromide emulsion (4.3 mol-% iodide, average grain diameter 0.70 μm) containing 2.5 g of $AgNO_3$, 1.6 g of gelatine and 0.21 g of the magenta coupler contained in the 6th layer, as well as 0.02 g of the masking coupler present in the 6th layer.

8th Layer: (intermediate layer)

0.5 g of gelatine and 0.15 g of 2,5-diisooctylhydroquinone.

9th layer: (yellow filter layer)

Yellow colloidal silver sol containing 0.2 g of Ag and 0.9 g of gelatine.

10th Layer: (low sensitivity, blue-sensitive layer)

Blue-sensitized silver iodobromide emulsion (4.9 mol-% iodide, average grain diameter 0.45 μm) containing 0.76 g of $AgNO_3$, 0.85 g of gelatine and 1.35 g of yellow coupler corresponding to the following formula:

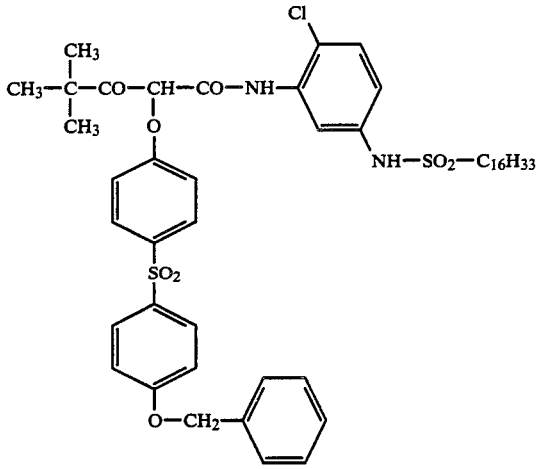

as well as 100 mg of DIR coupler 7.

11th Layer: (highly sensitive, blue-sensitive layer) Blue-sensitized silver iodobromide emulsion (3.3 mol-% iodide, average grain diameter 0.85 μm) containing 1.0 g of $AgNO_3$, 0.85 g of gelatine and 0.5 g of the yellow coupler contained in layer 10.

12th Layer: (protective layer):

1.2 g of gelatine.

13th Layer: (hardening layer):

15 g of gelatine and 0.7 g of a conventional hardener.

These four layer combinations 2A, 2B, 2F and 2G are only intended to illustrate the effect of the emulsions according to the present invention without limiting their effect to the application thereof in particular layer combinations or in particular layer sequences or the like. In particular, individual layers of the combinations may also contain different emulsions according to the present invention.

The amount of edge effect was determined as described in Example 1 on the four layer combinations, 2A, 2B, 2F and 2G which are here given as examples. The values obtained for macrodensity 1.0 (above fog) are entered in Table 7 above.

In addition, the sharpness was determined on materials 2A, 2B, 2F and 2G by means of the modulation transfer function (MTF). The method is described by T. H. James, in The Theory of the Photographic Process, 4th Edition, Macmillan Publ. Co. Inc. New York/London (1977) page 605.

Table 8 below shows those local frequencies (in lines per mm) at which the MTF has a value of 50%. The higher MTF values obtained with the emulsions according to the present invention show that these emulsions produce a higher image sharpness.

The interimage effect of cyan and magenta which improves the colour quality is also improved by the emulsions according to the present invention. The "magenta interimage effect" entered in Table 7 indicates by how many percent the magenta gradation is greater in the case of exposure to green light than on exposure to white light (cyan IIE analogous).

For determining the edge effect, the MTF and the interimage effect, the materials mentioned in this Example are processed by the same colour negative process as in Example 1.

TABLE 8

| Layer Combination | Emulsion in the low sensitivity layers 3 and 6 Identification | | IIE (%) Cyan | IIE (%) Magenta | Edge effect at macrodensity = 1.0 (above fog) Cyan | Edge effect at macrodensity = 1.0 (above fog) Magenta | Lines/mm at which MTF = 50% Cyan | Lines/mm at which MTF = 50% Magenta |
|---|---|---|---|---|---|---|---|---|
| 2A | A | hetero-disperse comparison | 20 | 10 | 0.23 | 0.19 | 19 | 33 |
| 2B | B | homo disperse comparison | 34 | 11 | 0.25 | 0.22 | 24 | 35 |
| 2F | F | present invention | 42 | 38 | 0.60 | 0.48 | 29 | 48 |
| 2G | G | present invention | 44 | 40 | 0.65 | 0.54 | 33 | 50 |

We claim:

1. Colour photographic recording material comprising a support layer, a DIR compound in at least one layer, at least one silver halide emulsion layer, which contains at least one iodide-containing silver halide emulsion comprising substantially silver halide grains having zones of differing halide compositions wherein in the grains:

(a) at least three zones differing in halide compositions are arranged in succession from the surface of the grain to the centre of the grain and the local iodide content assumes a maximum at least in one position which is not on the surface and not at the centre;

(b) the difference between the iodide content of the zone having the highest iodide content and the iodide content of the zone of lowest iodide content situated further away from the grain centre is at least 6 mol-%;

(c) the proportion of the zones in which the iodide content assumes a maximum amounts to from 10 to 60 mol-%; and (d) at least 50% of the crystals are cubes or tetradecahedrons;

and wherein the percentage of the silver iodide content is based on the silver halide content in the zones referred to.

2. Recording material according to claim 1 wherein the grains comprise an iodide-free or low iodide core, an iodide-rich zone and a low iodide zone.

3. Recording material according to claim 1 wherein the grains contain chloride in at least one of the zones.

4. Recording material according to claim 1 wherein the silver halide emulsion is monodsperse.

5. Color photographic recording material comprising a support layer, a DIR compound in at least one layer, at least one silver halide emulsion layer, which contains at least one iodide-containing silver halide emulsion comprising substantially silver halide grains having zones of differing halide compositions wherein in the grains:

(a) at least three zones differing in halide compositions are arranged in succession from the surface of the grain to the centre of the grain and the local iodide content assumes a maximum at least in one position which is not on the surface and not at the centre;

(b) the difference between the iodide content of the zone having the highest iodide content and the iodide content of the zone of lowest iodide content situated further away from the grain centre is at least 6 mol-%;

(c) the proportion of the zones in which the iodide content assumes a maximum amounts to from 10 to 60 mol-%;

(d) at least 50% of the crystals are cubes or tetradecahedrons or transitional forms between cubes and tetradecahedrons;

(e) none of said three zones is identical in halide composition with any of the other two zones;

(f) the outermost zone comprises a small iodide content and wherein the percentage of the silver iodide content is based on the silver halide content in the zone referred to.

6. Photographic recording to claim 5, wherein the core of said grains are free of essential amounts of iodide.

7. Recording material according to claim 5, wherein the silver halide emulsion is monodisperse.

* * * * *